US007189294B2

(12) United States Patent
Kimura et al.

(10) Patent No.: US 7,189,294 B2
(45) Date of Patent: Mar. 13, 2007

(54) AL-MG-SI SERIES ALLOY PLATE, METHOD FOR MANUFACTURING THE SAME AND AL-MG-SI SERIES ALLOY MATERIAL

(75) Inventors: Kazuo Kimura, Sakai (JP); Nobuhiko Akagi, Sakai (JP)

(73) Assignee: Showa Denko K.K., Tokyo (JP)

( * ) Notice: Subject to any disclaimer, the term of this patent is extended or adjusted under 35 U.S.C. 154(b) by 67 days.

(21) Appl. No.: 10/376,266

(22) Filed: Mar. 3, 2003

(65) Prior Publication Data

US 2004/0079457 A1 Apr. 29, 2004

Related U.S. Application Data

(60) Provisional application No. 60/374,500, filed on Apr. 23, 2002.

(30) Foreign Application Priority Data

Mar. 1, 2002 (JP) ..... 2002-055392
Feb. 28, 2003 (JP) ..... 2003-052621

(51) Int. Cl.
*C22F 1/05* (2006.01)

(52) U.S. Cl. ..... 148/692; 148/693; 148/697

(58) Field of Classification Search ..... 148/551, 148/552, 691–698, 702
See application file for complete search history.

(56) References Cited

U.S. PATENT DOCUMENTS 3,911,819 A 10/1975 Pryor et al.
4,019,931 A * 4/1977 Setzer et al. ..... 148/549
5,266,130 A * 11/1993 Uchida et al. ..... 148/552
5,480,498 A * 1/1996 Beaudoin et al. ..... 148/549
6,120,623 A * 9/2000 Gupta et al. ..... 148/552

FOREIGN PATENT DOCUMENTS

CN 1083541 A 3/1994
CN 1160772 A 10/1997
CN 1233294 A 10/1999

(Continued)

OTHER PUBLICATIONS

W. Hufnagel, "Key to Aluminium Alloys, 4th Edition", Aluminium-Schluessel, Key to Aluminium Alloys, XP-002194851, 1991, pp. 195-205.

*Primary Examiner*—Roy King
*Assistant Examiner*—Janelle Morillo
(74) *Attorney, Agent, or Firm*—Oblon, Spivak, McClelland, Maier & Neustadt, P.C.

(57) ABSTRACT

A method for manufacturing an Al—Mg—Si series alloy plate includes the steps of hot-rolling and subsequently cold-rolling an Al—Mg—Si series alloy ingot. The Al—Mg—Si series alloy ingot consists of Si: 0.2 to 0.8 mass %, Mg: 0.3 to 1 mass %, Fe: 0.5 mass % or less, Cu: 0.5 mass % or less, at least one of elements selected from the group consisting of Ti: 0.1 mass % or less and B: 0.1 mass % or less and the balance being Al and inevitable impurities. Heat-treating for holding a rolled ingot at 200 to 400° C. for 1 hour or more is performed after a completion of the hot-rolling but before a completion of the cold-rolling.

36 Claims, 2 Drawing Sheets

FOREIGN PATENT DOCUMENTS

| | | | | |
|---|---|---|---|---|
| EP | 0 506 100 | A1 | | 9/1992 |
| JP | 63-89640 | | | 4/1988 |
| JP | 5-279820 | | | 10/1993 |
| JP | 05279820 | A | * | 10/1993 |
| JP | 2000-87198 | | | 3/2000 |
| JP | 2000-226628 | | | 8/2000 |
| JP | 2000-239811 | | | 9/2000 |
| NL | 1010186 | | | 6/1999 |
| TW | 00313591 | | | 8/1997 |

* cited by examiner

AL-MG-SI SERIES ALLOY PLATE, METHOD FOR MANUFACTURING THE SAME AND AL-MG-SI SERIES ALLOY MATERIAL

CROSS REFERENCE TO RELATED APPLICATIONS

This application is an application filed under 35 U.S.C. § 111(a) claiming the benefit pursuant to 35 U.S.C. § 119(e)(1) of the filing date of Provisional Application No. 60/374,500 filed on Apr. 23, 2002 pursuant to 35 U.S.C. § 111(b).

Priority is claimed to Japanese Patent Application No. 2002-55392, filed on Mar. 1, 2002, U.S. Provisional Patent Application No. 60/374,500, filed on April 23, 2002 and Japanese Patent Application No. 2003-52621, filed on Feb. 28, 2003, the disclosure of which are incorporated by reference in their entireties.

TECHNICAL FIELD

The present invention relates to a method for manufacturing an Al—Mg—Si series alloy plate and an Al—Mg—Si series alloy plate manufactured by the method.

Furthermore, the present invention relates to an Al—Mg—Si series alloy plate, more especially to an Al—Mg—Si series alloy plate excellent in thermal conductivity, electrical conductivity, strength and workability and a method for manufacturing the same, and an Al—Mg—Si series alloy material.

BACKGROUND ART

In a material constituting a member to which a built-in heat source or a heat source is attached such as a chassis or a metal base print circuit board for use in a PDP (plasma display), an LCD (Liquid Crystal Display) or a note-type personal computer, it is required to be excellent in thermal conductivity for quick heat dissipation as well as excellent in strength. Furthermore, since the heat load of such a member has increased greatly in recent years because of the improved performance, the increased complication, the miniaturization and the increased density of such a heat source, it is also required that the thermal conductivity and the workability of such a heat source are improved.

In cases where the aforementioned member is made of aluminum, pure aluminum series alloy such as JIS 1100, JIS 1050 or JIS 1070 aluminum alloy is suitably used as a material having high thermal conductivity. However, these alloys are poor in strength. On the other hand, JIS 5052 aluminum alloy adopted as high strength material is remarkably lower than pure aluminum series alloy in thermal conductivity. Furthermore, Al—Mg—Si series alloy is excellent in thermal conductivity and can be improved in strength by conducting age-hardening. Such Al—Mg—Si alloy is, however, required to be subjected to complicated processing such that the alloy is rolled at high temperature, then the rolled alloy is subjected to solution treating, and thereafter the solution treated alloy is subjected to aging treating. Even if high strength can be obtained, there are defects such that the formability such as bendability or stretchability deteriorates extremely (see, e.g., Japanese Unexamined Laid-open Patent Publication Nos. 8-209279, 9-1343644 and 2000-144294).

Under the circumstances, the present applicant has proposed technique for manufacturing an Al—Mg—Si series alloy plate in which rolling conditions of hot-rolling are regulated to thereby obtain both the thermal conductivity and the strength without performing solution treatment and aging treatment (see, e.g., Japanese Unexamined Laid-open Patent Publication Nos. 2000-87198 and 2000-226628).

The aforementioned technique, however, requires complicated condition management such that, in any one of passes for hot-rolling, the material temperature immediately before the pass, the cooling rate between passes, the material temperature immediately after the pass and the thickness of the material immediately after the pass and the reduction ratio at the subsequent cold-rolling are controlled.

Furthermore, the workability of obtained alloy plate does not fully meet the commercial demands. In cases where the forming is performed under severe conditions, it was necessary to pay special attention to the processing facility and the processing method.

In the meantime, it is known that aluminum alloys ranging from JIS 1000 series aluminum alloy to JIS 7000 series aluminum alloy have an excellent correlation between thermal conductivity and electrical conductivity. When performing a regression analysis of the relation between the thermal conductivity and the electrical conductivity of the aluminum alloy shown in FIG. 2, the regression equation: $y=3.5335x+13.525$ and the determination constant: $R^2=0.981$ can be obtained. This shows extremely high correlation. Accordingly, an aluminum alloy plate having excellent thermal conductivity is also excellent in electrical conductivity, and therefore the alloy plate can be used not only as a heat dissipation member material but also as a current carrying element material.

DISCLOSURE OF INVENTION

In view of the aforementioned technical background, it is an object of the present invention to provide a method for manufacturing an Al—Mg—Si series alloy plate at simpler at fewer steps, an Al—Mg—Si series alloy plate manufactured by the method.

Furthermore, in view of the aforementioned technical background, it is an object of the present invention to provide a method for manufacturing an Al—Mg—Si series alloy plate excellent in thermal conductivity, electrical conductivity, strength and workability at simpler at fewer steps, and an Al—Mg—Si series alloy plate manufactured by the method. Furthermore, the present invention aims to provide an Al—Mg—Si series alloy member excellent in thermal conductivity, electrical conductivity, strength and workability.

In order to attain the aforementioned object, according to the present invention, a method for manufacturing an Al—Mg—Si series alloy plate, comprises:

(1) hot-rolling and subsequently cold-rolling an Al—Mg—Si series alloy ingot, wherein the Al—Mg—Si series alloy ingot consists of Si: 0.2 to 0.8 mass %, Mg:0.3 to 1 mass %, Fe: 0.5 mass % or less, Cu: 0.5 mass % or less, at least one of elements selected from the group consisting of Ti: 0.1 mass % or less and B: 0.1 mass % or less and the balance being Al and inevitable impurities, and wherein heat-treating for holding a rolled ingot at 200 to 400° C. for 1 hour or more is performed after a completion of the hot-rolling but before a completion of the cold-rolling.

(2) In the method for manufacturing an Al—Mg—Si series alloy plate as recited in the aforementioned item (1), Mn and Cr contained in the ingot are controlled such that a content of Mn is 0.1 mass % or less and a content of Cr is 0.1 mass % or less.

(3) In the method for manufacturing an Al—Mg—Si series alloy plate as recited in the aforementioned item (1)

or(2), the heat-treating is performed after the completion of the hot-rolling but before the cold-rolling.

(4) In the method for manufacturing the Al—Mg—Si series alloy plate as recited in the aforementioned item (1) or (2), the heat-treating is performed during the cold-rolling.

(5) In the method for manufacturing the Al—Mg—Si series alloy plate as recited in any one of the aforementioned items (1) to (4), the heat-treating is performed at 220 to 280° C. for 1 to 10 hours.

(6) In the method for manufacturing the Al—Mg—Si series alloy plate as recited in any one of the aforementioned items (1) to (5), homogenization processing of the alloy ingot is further performed at 500° C. or above.

(7) In the method for manufacturing the Al—Mg—Si series alloy plate as recited in any one of the aforementioned items (1) to (6), the cold-rolling after the heat-treating is performed at a reduction ratio of 20% or more.

(8) In the method for manufacturing the Al—Mg—Si series alloy plate as recited in the aforementioned item (7), the reduction ratio is 30% or more.

(9) In the method for manufacturing the Al—Mg—Si series alloy plate as recited in any one of the aforementioned items (1) to (8), final annealing is further performed at 200° C. or below after the completion of the cold-rolling.

(10) In the method for manufacturing the Al—Mg—Si series alloy plate as recited in the aforementioned item (9), the final annealing is performed at 110 to 150° C.

(11) In the method for manufacturing the Al—Mg—Si series alloy plate as recited in any one of the aforementioned item (1) to (10), the alloy ingot is preheated to 450 to 580° C. before performing the hot-rolling.

(12) In the method for manufacturing the Al—Mg—Si series alloy plate as recited in any one of the aforementioned items (1) to (11), the hot-rolling includes a plurality of passes, and the material temperature before any one of the passes is set to be 450 to 350° C. and the cooling rate after the one of the passes is set to be 50° C./minute or more.

(13) In the method for manufacturing the Al—Mg—Si series alloy plate as recited in any one of the aforementioned items (1) to (12), a Si content of the alloy ingot is 0.32 to 0.6 mass %.

(14) In the method for manufacturing the Al—Mg—Si series alloy plate as recited in any one of the aforementioned items (1) to (12), a Mg content of the alloy ingot is 0.35 to 0.55 mass %.

(15) In the method for manufacturing the Al—Mg—Si series alloy plate as recited in any one of the aforementioned items (1) to (12), a Fe content of the alloy ingot is 0.1 to 0.25 mass %.

(16) In the method for manufacturing the Al—Mg—Si series alloy plate as recited in any one of the aforementioned items (1) to (12), a Cu content of the alloy ingot is 0.1 mass % or less.

(17) In the method for manufacturing the Al—Mg—Si series alloy plate as recited in any one of the aforementioned items (1) to (12), a Ti content of the alloy ingot is 0.005 to 0.05 mass %.

(18) In the method for manufacturing the Al—Mg—Si series alloy plate as recited in any one of the aforementioned items (1) to (12), a B content of the alloy ingot is 0.06 mass % or less.

(19) In the method for manufacturing the Al—Mg—Si series alloy plate as recited in any one of the aforementioned items (1) to (12), a Mg content of the alloy ingot is controlled to be 0.05 mass % or less.

(20) In the method for manufacturing the Al—Mg—Si series alloy plate as recited in any one of the aforementioned items (1) to (12), a Cr content of the alloy ingot is controlled to be 0.05 mass % or less.

(21) An Al—Mg—Si series alloy material consists of Si: 0.2 to 0.8 mass %, Mg:0.3 to 1 mass %, Fe: 0.5 mass % or less, Cu: 0.5 mass % or less, at least one of elements selected from the group consisting of Ti: 0.1 mass % or less and B: 0.1 mass %, and the balance being Al and inevitable impurities, wherein electrical conductivity of the alloy material is 55 to 60% (IACS).

(22) In the Al—Mg—Si series alloy material as recited in the aforementioned item (21), tensile strength of the alloy material is 140 to 240 N/mm$^2$.

(23) The Al—Mg—Si series alloy material as recited in the aforementioned item (21) or (22), Mn and Cr as impurities of the alloy are controlled to be Mn: 0.1 mass % or less and Cr: 0.1 mass % or less.

(24) An Al—Mg—Si series alloy plate manufactured by the method as recited in any one of the aforementioned items (1) to (20).

(25) In the Al—Mg—Si series alloy plate as recited in any one of the aforementioned items (21) to (24), the Al—Mg—Si series alloy plate is a member selected from the group consisting of a heat dissipation member, an electrically conductive member, a casing member, a light reflecting member or its supporting member.

(26) In the Al—Mg—Si series alloy plate as recited in any one of the aforementioned items (21) to (24), the Al—Mg—Si series alloy plate is a member selected from the group consisting of a plasma display rear surface chassis member, a plasma display box member and a plasma display exterior member.

(27) In the Al—Mg—Si series alloy plate as recited in any one the aforementioned items (21) to (24), the Al—Mg—Si series alloy plate is a member selected from the group consisting of a liquid crystal display rear chassis member, a liquid crystal display bezel member, a liquid crystal display reflecting sheet member, a liquid crystal display reflecting sheet supporting member and a liquid crystal display box material.

BRIEF DESCRIPTION OF DRAWINGS

FIGS. 1A and 1B are flow charts showing a sequence of steps of a method for manufacturing an Al—Mg—Si series alloy plate, wherein FIG. 1A is a flow chart showing a sequence of steps of a method for manufacturing an Al—Mg—Si series alloy plate in which heat treating is performed after a completion of hot-rolling but before cold-rolling, and wherein FIG. 1B is a flow chart showing a sequence of steps of a method for manufacturing an Al—Mg—Si series alloy plate in which heat treating is performed during cold-rolling.

BEST MODE FOR CARRYING OUT THE INVENTION

Figure 1A:
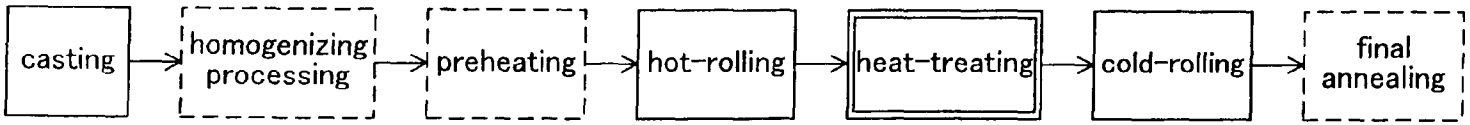

In the target Al—Mg—Si alloy composition of the present invention, the significance of each element and the reason for limiting the content will be explained as follows.

Mg and Si are elements required to enhance strength, and the amount of Si should be 0.2 to 0.8 mass % and that of Mg should be 0.3 to 1 mass %. If the Si content is less than 0.2 mass % or the Mg content is less than 0.3 mass %, sufficient strength cannot be obtained. On the other hand, if the Si content exceeds 0.8 mass % or the Mg content exceeds 1 mass %, the rolling load at the hot-rolling increases, causing deterioration of productivity and generation of larger cracks, which requires trimming during the manufacturing processing. Furthermore, the formability also deteriorates. The preferable Si content is 0.32 to 0.6 mass %, and the preferable Mg content is 0.35 to 0.55 mass %.

Fe and Cu are components required to perform a forming. However, if these components are contained too much, the alloy plate deteriorates in corrosion resistance and lacks in practicality. Therefore, it is necessary to control such that the Fe content is 0.5 mass % or less, preferably 0.35 mass % or less and the Cu content is 0.5 mass % or less, preferably 0.2 mass %. The more preferable Fe content is 0.1 to 0.25 mass %, and the more preferable Cu content is 0.1 mass % or less.

Ti and B are effective in fining a grain and preventing a generation of solidification cracks at the time of casting the alloy into a slab. The aforementioned effects can be obtained by adding at least one of Ti and B. Both of them may be added. However, if a large amount of Ti and/or B is contained, an amount of intermetallic compound increases and a larger intermetallic compound is formed. Therefore, the workability deteriorates. In addition, the thermal conductivity and the electrical conductivity of the product deteriorate. Accordingly, the Ti content should be 0.1 mass % or less. The preferable Ti content is 0.005to 0.05mass %. The B content should be 0.1 mass % or less. The preferable B content is 0.06 mass % or less.

Although an alloy ingot contains various inevitable impurities, it is preferable that the content of Mn and Cr is as small as possible because they deteriorate thermal conductivity and electrical conductivity. It is preferable that the amount of Mn as impurities is controlled to be 0.1 mass % or less and the amount of Cr as impurities is controlled to be 0.1 mass % or less. More preferably, the Mn content is 0.05 mass % or less and the Cr content is 0.05 mass % or less. The optimal Mn content is 0.04 mass % or less and the optimal Cr content is 0.03 mass % or less. It is preferable that each of another impurities is 0.05 mass % or less.

Next, the sequence of processing steps in the method of the present invention will be detailed with reference to FIGS. 1A and 1B.

In normal rolling processing, an alloy ingot is formed into an alloy plate of a predetermined thickness via hot-rolling and cold-rolling, and various heat treatments are conducted between or during the rolling. In the method of the present invention, a heat-treating is performed under predetermined conditions after the completion of hot-rolling but before a completion of cold-rolling. Concretely, the heat-treating is performed after the completion of the hot-rolling (see FIG. 1A). Alternatively, the heat-treating is performed during the cold-rolling, in other words, between the cold-rolling passes (see FIG. 1B). In FIGS. 1A and 1B, the heat treating is shown by a double-line block, the essential processing are shown by a solid-line block, and arbitral processing is shown by a broken-line block.

The aforementioned heat treating aims to deposit $Mg_2Si$ finely and uniformly and decrease processing distortion existing in the material. The subsequent cold-rolling hardens the material. Thus, an alloy plate of high strength can be obtained without spoiling formability. It is preferable to perform this heat treating in the state in which processing distortion exists in the material. It is recommended that the heat treating is performed in the state in which processing distortion certainly exists after performing at least one pass of cold-rolling after the hot-rolling as shown in FIG. 1B.

The heat treating should be performed at 200 to 400° C. for 1 hour or more. If the temperature is lower than 200° C., it takes a longer time to obtain the aforementioned effects. To the contrary, if the temperature exceeds 400° C., the large particles of precipitate will be formed, and therefore a final product having high strength and good formability cannot be obtained. Furthermore, if the temperature exceeds 450° C., recrystallized grains become larger, affecting the formability of the final product. Furthermore, in cases where the processing time is less than 1 hour, the aforementioned effects cannot be obtained. Preferably, the heat treating is performed under the conditions of 1 hour or more at 200 to 300° C., more preferably 1 to 10 hours at 220 to 280° C.

Next, arbitrary processing and rolling other than the aforementioned heat treating will be explained.

Homogenization processing to the alloy ingot is performed arbitrarily. It is preferable to perform homogenization processing at 500° C. or above. In this case, the micro structure of the alloy can be homogenized.

The hot-rolling is preferably performed after dissolving crystallized objects, Mg and Si in the material and making a uniform micro structure by preheating. Quality stability of a final product can be secured by initiating the rolling of the material having uniform micro structure. It is preferable that the preheating is performed at 450° C. or more, more preferably at 500° C. or more. However, if the temperature exceeds 580° C., eutectic fusion occurs. Therefore, it is preferable to perform the preheating at 580° C. or less.

The conditions of hot-rolling are not specifically limited. A conventional method in which rough hot-rolling and the subsequent hot finish rolling are performed can be employed. In an arbitrary rolling pass, it is preferable that the material temperature immediately before the pass is set to be 450 to 350° C. and the cooling rate after the pass is set to be 50° C./minute or more. It is suppressed that a generation of large and rough deposits of $Mg_2Si$ after the pass from the state in which Mg and Si are dissolved before the pass can be suppressed. Accordingly, the same effects as quenching can be obtained and the quality of the final product can be stabilized. If the material temperature before the pass is lower than 350° C., at this time $Mg_2Si$ serves as large and rough deposits, and the following quenching effects cannot be obtained. Furthermore, since the temperature of the material is low, the rolling performance at the subsequent pass deteriorates remarkably and the material temperature immediately after the pass becomes too low. Therefore the surface quality of the rolled plate deteriorates. On the other hand, if the temperature exceeds 450° C., the material temperature immediately after the pass does not drop sufficiently, resulting in insufficient quenching effects. It is especially preferable that the material temperature immediately before the pass falls within the range of 420 to 380° C.

In the cold-rolling to be performed after the heat treating, in order to obtain predetermined strength by work hardening, it is preferable that the reduction ratio is set to be 20% or more. More preferably, the reduction ratio is set to be 30% or more. Regarding the reduction ratio of the cold-rolling to be performed before the heat treating as shown in FIG. 1B, since the purpose of this cold-rolling is to generate processing distortion in the material to be subjected to the subsequent heat-treating, the aforementioned reduction ratio is not applied.

Furthermore, if required, the cold rolled alloy plate is subjected to final annealing at 200° C. or below. By conducting the heat treatment at low temperature, Mg and Si dissolved in the material deposits as $Mg_2Si$, which further improves the strength and the elongation of the rolled alloy plate. Furthermore, the final annealing can stabilize the mechanical characteristics of the plate. The more preferable annealing temperature is 110 to 150° C.

According to the method for manufacturing the Al—Mg—Si series alloy plate of the present invention, an Al—Mg—Si series alloy plate having high strength and good workability can be obtained by the heat treating under the predetermined conditions and the subsequent cold-rolling. Since this heat treating is to simply hold the material at a predetermined temperature, the treatment can be performed within the range of the rolling processing control, and additional complicated processing such as conventional solution treating, quenching or tempering will not be required. Furthermore, since an Al—Mg—Si series alloy itself is excellent in thermal conductivity and electrical conductivity, an alloy plate having thermal conductivity, electrical conductivity, strength and workability can be manufactured at simpler and fewer steps.

The Al—Mg—Si series alloy plate manufactured by the method according to the present invention is excellent in characteristics mentioned above. Therefore, the alloy plate can be subjected to various forming processing. For example, the alloy plate can be preferably used as heat dissipation member material, current carrying member material, or reflecting plate or its supporting member. The aforementioned heat dissipation member includes not only a member for dissipating heat as its original purpose, e.g., a heat exchanger and a heat sink, but also a member required to have heat dissipation performance other than its main purpose, e.g., a chassis or a metal base print circuit board of an electronic product such as a PDP, an LCD or a personal computer to which a built-in heat source or a heat source is attached. As for the current carrying member, a bus bar member, various battery terminals member, capacitor terminal member for use in a fuel cell vehicle or a hybrid car, terminal members of various electrical equipment and terminal members of machine appliance can be exemplified. Since the alloy plate according to the present invention is excellent in strength and workability, the thin alloy plate can be used for a casing, and it is possible to provide a casing having sufficient strength which is small in size and light in weight. As for the reflecting plate, a light reflecting plate for a liquid crystal beneath type backlight, a light reflecting plate for a liquid crystal edge-light type unit and a reflecting plate for an electric decorative display can be exemplified. The alloy plate may also be used as a supporting member for the aforementioned reflecting plate made of material other than aluminum. For example, a reflecting plate in which a porous resin sheet made of foamed resin composition containing inorganic filler such as olefin series polymer, barium sulfate, calcium carbonate or titanium oxide is laminated on the Al—Mg—Si series alloy plate of the present invention can be exemplified. The porous resin sheet is laminated on a supporting member by lamination processing or via an adhesive tape. Furthermore, as a material of a reflecting plate, white paint is sometimes used. In this case, a supporting member on which white paint is applied can be used as a reflecting plate. Furthermore, as a member to which heat dissipation, strength and lightness are required, a keyboard substrate for use in a computer, especially a note-type computer which should be extremely small in size and light in weight, a heat spreader plate and a box can be exemplified. Furthermore, it can be used as various strengthening members.

Concretely, the Al—Mg—Si series alloy plate can be used as a material for a plasma display related material such as a plasma display rear surface chassis member, a plasma display box member and a plasma display exterior member, or a liquid crystal display material such as a liquid crystal display rear chassis member, a liquid crystal display bezel member, a liquid crystal display reflecting sheet member, a liquid crystal display reflecting sheet supporting member and a liquid crystal display box material. The aforementioned liquid crystal display rear chassis member can be also served as a heat dissipation plate.

The Al—Mg—Si series alloy material according to the present invention has the same composition as the aforementioned Al—Mg—Si series alloy plate, and has excellent electrical conductivity of 55 to 60% (IACS). Furthermore, as mentioned above, since the electrical conductivity and the thermal conductivity are high in correlation, the alloy material has excellent thermal conductivity. In an alloy material having tensile strength of 140 to 240 $N/mm^2$, both the strength and the workability can be served. If the strength is less than 140 $N/mm^2$, the strength becomes insufficient although the workability is sufficient. To the contrary, if the strength exceeds 240 $N/mm^2$, although the strength is improved, the workability becomes insufficient, and therefore the balance thereof deteriorates. This Al—Mg—Si series alloy member can be manufactured by, for example, the method for manufacturing an Al—Mg—Si series alloy plate according to the present invention in which predetermined heat treating is executed after the hot-rolling but before a completion of the cold-rolling. As a result, the tensile strength covering the aforementioned range can be attained by the effect for depositing Fe, Mg, Si which are contained elements and the effect for decreasing the cold-rolling reduction ratio due to the recovery recrystallization by the heat treating.

According to the Al—Mg—Si series alloy, since the Al—Mg—Si series alloy ingot consists of Si: 0.2 to 0.8 mass %, Mg:0.3 to 1 mass %, Fe: 0.5 mass % or less, Cu: 0.5 mass % or less, at least one of elements selected from the group consisting of Ti: 0.1 mass % or less and B: 0.1 mass % or less and the balance being Al and inevitable impurities, it is excellent in thermal conductivity and electrical conductivity. Furthermore, in the method of manufacturing an alloy plate including hot-rolling and subsequently cold-rolling the Al—Mg—Si series alloy ingot, since heat-treating for holding a rolled ingot at 200 to 400° C. for 1 hour or more is performed after a completion of the hot-rolling but before a completion of the cold-rolling, $Mg_2Si$ are deposited finely and uniformly during the heat treatment and processing distortion existing in the material decreases. The subsequent cold-rolling hardens the material. Thus, an alloy plate of high strength can be obtained without spoiling formability. Since this heat treating is to simply hold the material at a predetermined temperature, the treatment can be performed within the range of the rolling processing control, and additional complicated processing such as conventional solution treating, quenching or tempering will not be required. Furthermore, an alloy plate having thermal conductivity, electrical conductivity, strength and workability can be manufactured at simpler and fewer steps.

Furthermore, in the alloy ingot, in cases where Mn and Cr contained in the ingot are controlled such that a content of Mn is 0.1 mass % or less and a content of Cr is 0.1 mass % or less, an alloy plate which is further excellent in thermal conductivity and electrical conductivity can be obtained.

The heat-treating can be performed after the completion of the hot-rolling but before the cold-rolling or during the cold-rolling.

In cases where the heat-treating is performed at 220 to 280° C. for 1 to 10 hours, the aforementioned effects can be obtained more efficiently.

In cases where homogenization processing of the alloy ingot is further performed at 500° C. or above, the micro structure of the alloy can be homogenized.

In cases where the cold-rolling after the heat-treating is performed at a reduction ratio of 20% or more, especially 30% or more, enough improvement of strength due to work hardening can be attained.

In cases where final annealing is performed at 200° C. or below, especially 110 to 150° C. after the completion of the cold-rolling, the strength can be further improved and the elasticity can be improved. Furthermore, the various mechanical properties can be stabilized.

In cases where the alloy ingot is preheated to 450 to 580° C. before performing the hot-rolling, intermetallic compounds, Mg and Si in the material are dissolved, resulting in uniform micro structure. Quality stability of a final product can be secured by initiating the rolling of the material having uniform metal texture.

Furthermore, in cases where the hot-rolling includes a plurality of passes, and the material temperature before any one of the passes is set to be 450 to 350° C. and the cooling rate after the one of the passes is set to be 50° C./minute or more, a generation of large and rough deposits of $Mg_2Si$ is suppressed, and therefore the same effects as quenching can be obtained and the quality of the final product can be stabilized.

In the aforementioned alloy ingot, in cases where a Si content of the alloy ingot is 0.32 to 0.6 mass %, an alloy plate having balanced strength and workability can be obtained.

Furthermore, in cases where a Mg content of the alloy ingot is 0.35 to 0.55 mass %, an alloy plate having balanced strength and workability can be obtained.

Furthermore, in cases where a Fe content of the alloy ingot is 0.1 to 0.25 mass %, excellent workability and corrosion resistance can be secured.

Furthermore, in cases where a Cu content of the alloy ingot is 0.1 mass % or less, excellent workability and corrosion resistance can be secured.

Furthermore, in cases where a Ti content of the alloy ingot is 0.005 to 0.05 mass %, excellent workability, thermal conductivity and electrical conductivity can be secured.

Furthermore, in cases where a B content of the alloy ingot is 0.06 mass % or less, excellent workability, thermal conductivity and electrical conductivity can be secured.

Furthermore, in cases where a Mn content of the alloy ingot is controlled to be 0.05 mass % or less, excellent thermal conductivity and electrical conductivity can be secured.

Furthermore, in cases where a Cr content of the alloy ingot is controlled to be 0.05 mass % or less, excellent thermal conductivity and electrical conductivity can be secured.

Since the Al—Mg—Si series alloy material of this invention has the aforementioned compositions and the electrical conductivity is 55 to 60% (IACS), the material has excellent thermal conductivity and electrical conductivity.

Furthermore, in cases where tensile strength of the alloy material is 140 to 240 $N/mm^2$, the material can have both strength and workability.

Furthermore, in cases where Mn and Cr as impurities of the alloy are controlled to be Mn: 0.1 mass % or less and Cr: 0.1 mass % or less, excellent thermal conductivity and electrical conductivity can be secured.

Since the An Al—Mg—Si series alloy plate is manufactured by the aforementioned method, the plate can be excellent in thermal conductivity and electrical conductivity.

Furthermore, the Al—Mg—Si series alloy plate can be preferably used as a heat dissipation member, an electrically conductive member, a casing member, a light reflecting member or its supporting member, can be subjected to various forming and can have the aforementioned various characteristics.

Furthermore, the Al—Mg—Si series alloy plate can be used as a plasma display rear surface chassis member, a plasma display box member and a plasma display exterior member, can be subjected to various forming and can have the aforementioned various characteristics.

Furthermore, the Al—Mg—Si series alloy plate can be used as a liquid crystal display rear chassis member, a liquid crystal display bezel member, a liquid crystal display reflecting sheet member, a liquid crystal display reflecting sheet supporting member and a liquid crystal display box material, can be subjected to various forming and can have the aforementioned various characteristics.

EXAMPLES

First, slabs were made by continuously casting each of the alloy each having compositions shown in Tables 1 to 5 in accordance with a conventional method. Some slabs were subjected to homogenization processing of 580° C.×10 hours, and others were not subjected to homogenization processing. Then, they were subjected to surface cutting. In the alloy composition shown in these tables, in Examples 1 to 55 and Comparative Examples 1 to 10, the Mn contents and Cr contents as impurities were controlled so as to be 0.1 wt % or less, respectively. Another impurities were 0.05 wt %, respectively. Examples 60A and 60B shown in Table 4 were different in Cr content, and the contents of the remaining elements are the same. Furthermore, the manufacturing steps mentioned later were also the same. Similarly, in Examples 61A and 61B, Examples 62A and 62B and Examples 63A and 63B, only the Mn content and Cr content are different. The amount of impurities in each Example in Table 4 were 0.05 mass % or less.

In Example 1, 3–9, 11–19, 21–24, 26, 28–34, 36–44, 46–49, 51, 52, 54, 55, 60A–62B and Comparative Examples 6–9, an alloy plate was manufactured by the process shown in FIG. 1A to obtain a test piece, respectively.

That is, each of the aforementioned slabs was preheated to the temperature shown in Tables 1 to 5, and the hot-rolling was initiated at the temperature. In the final pass of the rough hot-rolling, the material temperature immediately before the final pass was set to be 400° C., and the hot-rolled material was cooled at the rate of 80° C./minute after the final pass.

Subsequently, the hot-rolled plate was subjected to heat treatment by holding it at the temperature and the time shown in Tables 1 to 5, and then subjected to cold-rolling at the reduction ratio shown in Tables 1 to 5.

Furthermore, in Examples 3 and 28, the final annealing of 4 hours at 130° C. was performed. In another Examples, no final annealing was performed.

Figure 1B:
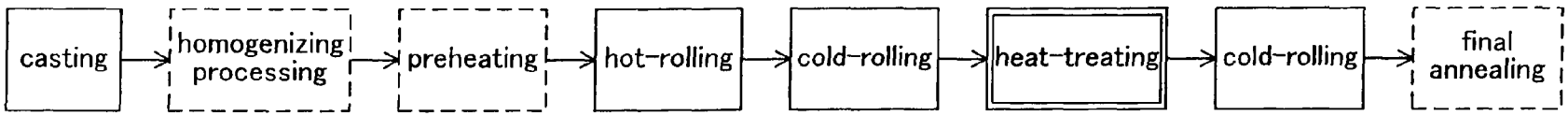
Figure 2:
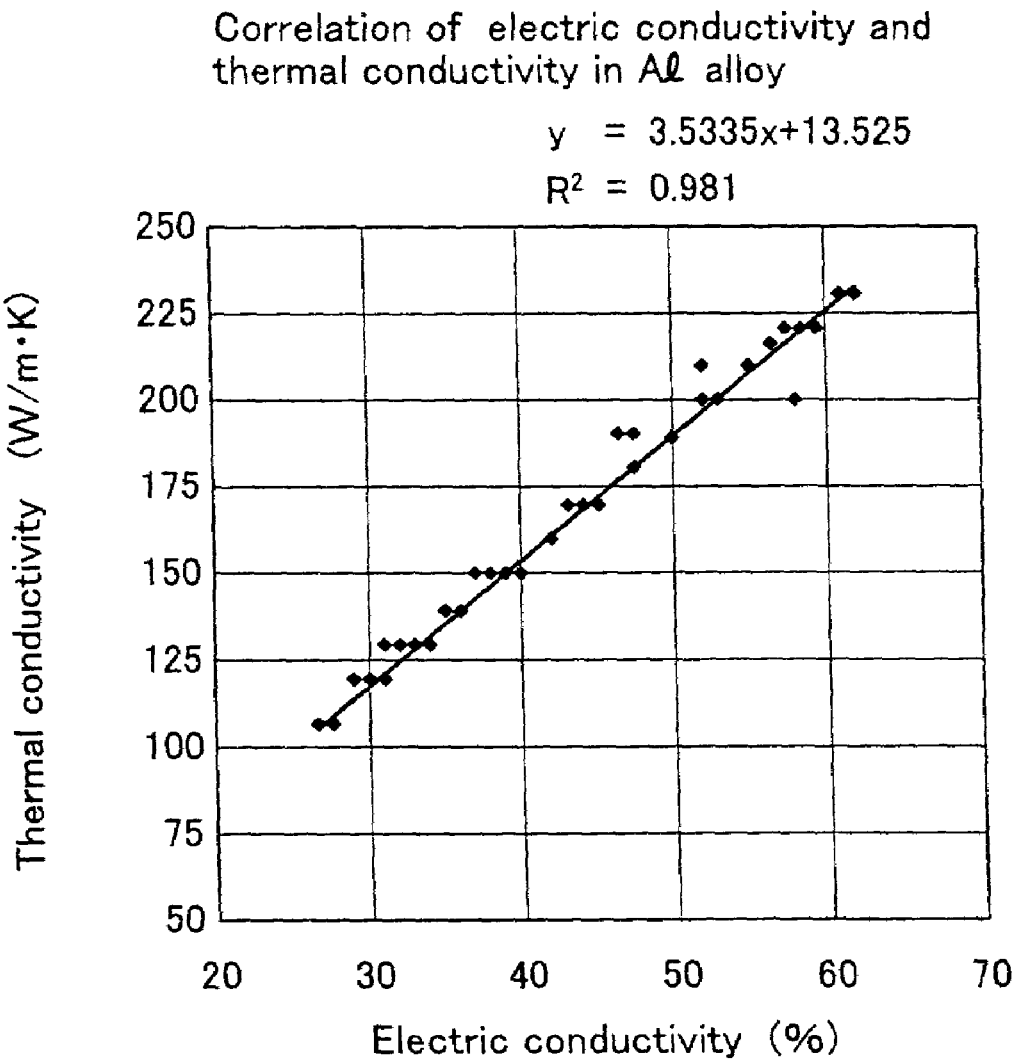
FIG. 2 is a correlation diagram showing a relationship between electrical conductivity and thermal conductivity of aluminum alloy.

Furthermore, in Examples 2, 10, 20, 25, 27, 35, 45, 50, 53, 63A and 63B and Comparative Example 10, an alloy plate was manufactured by the steps shown in FIG. 1B.

That is, each of the aforementioned slabs was preheated to the temperature shown in Tables 1 to 5, and the hot-rolling was initiated at the temperature. In the final pass of the rough hot-rolling, the material temperature immediately before the final pass was set to be 400° C., and the hot-rolled material was cooled at the rate of 80° C./minute after the final pass.

Subsequently, the hot-rolled plate was subjected to three passes of cold-rolling, and then heat treatment was performed by holding it at the temperature and the time shown in Tables 1 to 5.

Furthermore, in Examples 10 and 35, a final annealing of 4 hours at 130° C. was performed. In another Examples, no final annealing was performed.

In Comparative Examples 1 to 5, a commercially available rolling plate or extruded member was used as a test piece.

The tensile strength, thermal conductivity, electric conductivity and workability of each obtained test piece was evaluated by the following method. The evaluation results are also shown in Tables 1 to 5.

The tensile strength of each JIS No. 5 test piece was measured by a conventional method at ordinary temperature.

The thermal conductivity was measured by a laser flash method at 25° C.

The electric conductivity was measured based on IACS (20° C.). "IACS" denotes annealed standard soft copper internationally employed. The volume electric resistivity is $1.7241\times10^{-2}$ μΩm which is 100% IACS.

The workability was evaluated by the 5.3V block method of JIS Z 2248 metal material bending test method at the bending angle of 90 degrees and the inside radius of r=0 mm. The evaluation was shown as follows:

○: Good

Δ: Cracks were slightly generated

×: Cracks were generated

TABLE 1

| Alloy | Composition (mass %) balance: A1 | | | | | | Homogenizing Process- | Pre-heating | Heat treatment* | Cold rolling reduction | Final annealing | Tensile Strength | Thermal conductivity | Electric conductivity | Workability |
|---|---|---|---|---|---|---|---|---|---|---|---|---|---|---|---|
| No. | Si | Mg | Fe | Cu | Ti | B | ing | ° C. | ° C. × hr | ratio % | ° C. × hr | N/mm$^2$ | W/mK | (IACS) % | |
| Example | | | | | | | | | | | | | | | |
| 1 | 0.45 | 0.50 | 0.17 | 0.02 | 0.02 | — | Yes | 500 | Hot, 240 × 4 | 85 | None | 190 | 215 | 57.0 | ○ |
| 2 | 0.45 | 0.50 | 0.17 | 0.02 | 0.02 | — | Yes | 500 | Cold, 240 × 4 | 70 | None | 195 | 214 | 56.7 | ○ |
| 3 | 0.45 | 0.50 | 0.17 | 0.02 | 0.02 | — | Yes | 500 | Hot, 240 × 4 | 85 | 130 × 4 | 200 | 214 | 56.7 | ○ |
| 4 | 0.44 | 0.49 | 0.18 | 0.01 | 0.01 | — | Yes | 460 | Hot, 240 × 4 | 85 | None | 200 | 213 | 56.5 | ○ |
| 5 | 0.45 | 0.50 | 0.17 | 0.18 | 0.03 | — | Yes | 500 | Hot, 240 × 4 | 85 | None | 235 | 211 | 55.9 | ○ |
| 6 | 0.30 | 0.40 | 0.16 | 0.01 | 0.01 | — | Yes | 500 | Hot, 240 × 4 | 85 | None | 180 | 216 | 57.3 | ○ |
| 7 | 0.24 | 0.50 | 0.16 | 0.01 | 0.02 | — | Yes | 500 | Hot, 240 × 4 | 85 | None | 188 | 217 | 57.6 | ○ |
| 8 | 0.44 | 0.35 | 0.16 | 0.01 | 0.01 | — | Yes | 500 | Hot, 240 × 4 | 85 | None | 190 | 210 | 55.6 | ○ |
| 9 | 0.45 | 0.50 | 0.17 | 0.02 | 0.02 | — | Yes | 500 | Hot, 280 × 4 | 85 | None | 177 | 218 | 57.9 | ○ |
| 10 | 0.45 | 0.50 | 0.17 | 0.02 | 0.02 | — | Yes | 500 | Cold, 240 × 4 | 40 | 130 × 4 | 150 | 217 | 57.6 | ○ |
| 11 | 0.44 | 0.49 | 0.18 | 0.01 | 0.06 | — | Yes | 500 | Hot, 240 × 4 | 85 | None | 201 | 211 | 55.9 | ○ |
| 12 | 0.45 | 0.50 | 0.30 | 0.02 | 0.02 | — | Yes | 500 | Hot, 240 × 4 | 85 | None | 190 | 216 | 57.3 | ○ |
| 13 | 0.71 | 0.50 | 0.20 | 0.03 | 0.02 | — | Yes | 500 | Hot, 240 × 4 | 85 | None | 200 | 212 | 56.2 | ○ |
| 14 | 0.45 | 0.95 | 0.17 | 0.02 | 0.02 | — | Yes | 500 | Hot, 240 × 4 | 85 | None | 235 | 211 | 55.9 | ○ |
| 15 | 0.45 | 0.50 | 0.17 | 0.02 | 0.02 | — | Yes | 500 | Hot, 240 × 4 | 85 | None | 210 | 210 | 55.6 | ○ |
| 16 | 0.45 | 0.50 | 0.17 | 0.02 | 0.02 | — | Yes | 500 | Hot, 240 × 4 | 20 | None | 170 | 218 | 57.9 | ○ |
| 17 | 0.45 | 0.50 | 0.17 | 0.02 | 0.02 | — | No | 500 | Hot, 280 × 4 | 85 | None | 190 | 213 | 56.5 | ○ |
| 18 | 0.30 | 0.40 | 0.16 | 0.01 | 0.01 | — | No | 500 | Hot, 240 × 4 | 85 | None | 180 | 218 | 57.9 | ○ |
| 19 | 0.44 | 0.49 | 0.18 | 0.01 | 0.06 | — | No | 500 | Hot, 240 × 4 | 85 | None | 195 | 212 | 56.2 | ○ |
| 20 | 0.45 | 0.50 | 0.17 | 0.02 | 0.02 | — | No | 500 | Cold, 240 × 4 | 40 | None | 173 | 217 | 57.6 | ○ |
| 21 | 0.45 | 0.48 | 0.40 | 0.02 | 0.02 | — | Yes | 500 | Hot, 240 × 4 | 85 | None | 201 | 212 | 56.2 | ○ |
| 22 | 0.45 | 0.50 | 0.17 | 0.50 | 0.02 | — | Yes | 500 | Hot, 240 × 4 | 85 | None | 218 | 214 | 56.7 | ○ |
| 23 | 0.45 | 0.50 | 0.30 | 0.10 | 0.02 | — | Yes | 500 | Hot, 240 × 4 | 85 | None | 203 | 213 | 56.5 | ○ |
| 24 | 0.45 | 0.50 | 0.17 | 0.02 | 0.02 | — | Yes | 500 | Hot, 320 × 2 | 85 | None | 155 | 214 | 56.7 | ○ |
| 25 | 0.45 | 0.50 | 0.17 | 0.02 | 0.02 | — | Yes | 500 | Cold, 320 × 2 | 70 | None | 148 | 213 | 56.5 | ○ |

*Timing of Heat Treatment: "Hot" denotes "After hot-rolling"; "Cold" denotes "During the cold-rolling.

TABLE 2

| Alloy | Composition (mass %) balance: A1 | | | | | | Homogenizing Process- | Pre-heating | Heat treatment* | Cold rolling reduction | Final annealing | Tensile Strength | Thermal conductivity | Electric conductivity | Workability |
|---|---|---|---|---|---|---|---|---|---|---|---|---|---|---|---|
| No. | Si | Mg | Fe | Cu | Ti | B | ing | ° C. | ° C. × hr | ratio % | ° C. × hr | N/mm$^2$ | W/mK | (IACS) % | |
| Example | | | | | | | | | | | | | | | |
| 26 | 0.45 | 0.50 | 0.17 | 0.02 | — | 0.02 | Yes | 500 | Hot, 240 × 4 | 85 | None | 192 | 214 | 56.7 | ○ |
| 27 | 0.45 | 0.50 | 0.17 | 0.02 | — | 0.02 | Yes | 500 | Cold, 240 × 4 | 70 | None | 193 | 213 | 56.5 | ○ |

TABLE 2-continued

| Alloy No. | Composition (mass %) balance: A1 Si | Mg | Fe | Cu | Ti | B | Homogenizing Process-ing | Pre-heating ° C. | Heat treatment* ° C. × hr | Cold rolling reduction ratio % | Final annealing ° C. × hr | Tensile Strength N/mm$^2$ | Thermal conductivity W/mK | Electric conductivity (IACS) % | Workability |
|---|---|---|---|---|---|---|---|---|---|---|---|---|---|---|---|
| 28 | 0.45 | 0.50 | 0.17 | 0.02 | — | 0.02 | Yes | 500 | Hot, 240 × 4 | 85 | 130 × 4 | 199 | 213 | 56.5 | ○ |
| 29 | 0.44 | 0.49 | 0.18 | 0.01 | — | 0.01 | Yes | 460 | Hot, 240 × 4 | 85 | None | 197 | 211 | 56.0 | ○ |
| 30 | 0.45 | 0.50 | 0.17 | 0.18 | — | 0.03 | Yes | 500 | Hot, 240 × 4 | 85 | None | 230 | 210 | 56.0 | ○ |
| 31 | 0.30 | 0.40 | 0.16 | 0.01 | — | 0.01 | Yes | 500 | Hot, 240 × 4 | 85 | None | 182 | 218 | 57.3 | ○ |
| 32 | 0.24 | 0.50 | 0.16 | 0.01 | — | 0.02 | Yes | 500 | Hot, 240 × 4 | 85 | None | 187 | 217 | 57.6 | ○ |
| 33 | 0.44 | 0.35 | 0.16 | 0.01 | — | 0.01 | Yes | 500 | Hot, 240 × 4 | 85 | None | 191 | 211 | 55.9 | ○ |
| 34 | 0.45 | 0.50 | 0.17 | 0.02 | — | 0.02 | Yes | 500 | Hot, 280 × 4 | 85 | None | 179 | 214 | 56.5 | ○ |
| 35 | 0.45 | 0.50 | 0.17 | 0.02 | — | 0.02 | Yes | 500 | Cold, 240 × 4 | 40 | 130 × 4 | 155 | 215 | 56.5 | ○ |
| 36 | 0.44 | 0.49 | 0.18 | 0.01 | — | 0.06 | Yes | 500 | Hot, 240 × 4 | 85 | None | 200 | 211 | 55.9 | ○ |
| 37 | 0.45 | 0.50 | 0.30 | 0.02 | — | 0.02 | Yes | 500 | Hot, 240 × 4 | 85 | None | 193 | 215 | 56.8 | ○ |
| 38 | 0.71 | 0.50 | 0.20 | 0.03 | — | 0.02 | Yes | 500 | Hot, 240 × 4 | 85 | None | 198 | 213 | 56.5 | ○ |
| 39 | 0.45 | 0.95 | 0.17 | 0.02 | — | 0.02 | Yes | 500 | Hot, 240 × 4 | 85 | None | 234 | 210 | 55.6 | ○ |
| 40 | 0.45 | 0.50 | 0.17 | 0.02 | — | 0.02 | Yes | 500 | Hot, 240 × 4 | 85 | None | 209 | 211 | 55.9 | ○ |
| 41 | 0.45 | 0.50 | 0.17 | 0.02 | — | 0.02 | Yes | 500 | Hot, 240 × 4 | 20 | None | 177 | 219 | 58.3 | ○ |
| 42 | 0.45 | 0.50 | 0.17 | 0.02 | — | 0.02 | No | 500 | Hot, 280 × 4 | 85 | None | 194 | 214 | 56.7 | ○ |
| 43 | 0.30 | 0.40 | 0.16 | 0.01 | — | 0.01 | No | 500 | Hot, 240 × 4 | 85 | None | 182 | 218 | 58.1 | ○ |
| 44 | 0.44 | 0.49 | 0.18 | 0.01 | — | 0.06 | No | 500 | Hot, 240 × 4 | 85 | None | 192 | 214 | 56.7 | ○ |
| 45 | 0.45 | 0.50 | 0.17 | 0.02 | — | 0.02 | No | 500 | Cold, 240 × 4 | 40 | None | 172 | 218 | 57.9 | ○ |
| 46 | 0.45 | 0.48 | 0.40 | 0.02 | — | 0.02 | Yes | 500 | Hot, 240 × 4 | 85 | None | 200 | 211 | 56.5 | ○ |
| 47 | 0.45 | 0.50 | 0.17 | 0.50 | — | 0.02 | Yes | 500 | Hot, 240 × 4 | 85 | None | 217 | 214 | 56.7 | ○ |
| 48 | 0.45 | 0.50 | 0.30 | 0.10 | — | 0.02 | Yes | 500 | Hot, 240 × 4 | 85 | None | 202 | 211 | 56.5 | ○ |
| 49 | 0.45 | 0.50 | 0.17 | 0.02 | — | 0.02 | Yes | 500 | Hot, 320 × 2 | 85 | None | 157 | 221 | 58.8 | ○ |
| 50 | 0.45 | 0.50 | 0.17 | 0.02 | — | 0.02 | Yes | 500 | Cold, 320 × 2 | 70 | None | 151 | 220 | 59.0 | ○ |

*Timing of Heat Treatment: "Hot" denotes "After hot-rolling"; "Cold" denotes "During the cold-rolling.

TABLE 3

| Alloy No. | Composition (mass %) balance: A1 Si | Mg | Fe | Cu | Ti | B | Homogenizing Process-ing | Pre-heating ° C. | Heat treatment* ° C. × hr | Cold rolling reduction ratio % | Final annealing ° C. × hr | Tensile Strength N/mm$^2$ | Thermal conductivity W/mK | Electric conductivity (IACS) % | Workability |
|---|---|---|---|---|---|---|---|---|---|---|---|---|---|---|---|
| Example | | | | | | | | | | | | | | | |
| 51 | 0.45 | 0.50 | 0.17 | 0.02 | 0.01 | 0.01 | Yes | 500 | Hot, 350 × 2 | 70 | None | 145 | 214 | 56.7 | ○ |
| 52 | 0.45 | 0.50 | 0.17 | 0.02 | 0.01 | 0.01 | Yes | 500 | Hot, 240 × 4 | 85 | None | 201 | 216 | 56.9 | ○ |
| 53 | 0.45 | 0.50 | 0.17 | 0.02 | 0.01 | 0.01 | Yes | 500 | Cold, 240 × 4 | 70 | None | 179 | 215 | 56.8 | ○ |
| 54 | 0.45 | 0.50 | 0.17 | 0.02 | 0.01 | 0.01 | Yes | 500 | Hot, 240 × 4 | 85 | 130 × 4 | 204 | 213 | 56.5 | ○ |
| 55 | 0.45 | 0.50 | 0.17 | 0.02 | 0.01 | 0.01 | No | 500 | Hot, 240 × 4 | 85 | None | 202 | 216 | 56.9 | ○ |

*Timing of Heat Treatment: "Hot" denotes "After hot-rolling"; "Cold" denotes "During the cold-rolling.

TABLE 4

| Alloy No. | Composition (mass %) balance: A1 Si | Mg | Fe | Cu | Ti | B | Mn | Cr | Homogenizing Processing | Pre-heating ° C. | Heat treatment* ° C. × hr |
|---|---|---|---|---|---|---|---|---|---|---|---|
| Example | | | | | | | | | | | |
| 60A | 0.45 | 0.50 | 0.17 | 0.02 | — | 0.02 | 0.03 | 0.02 | Yes | 500 | Hot, |
| 60B | | | | | | | 0.05 | 0.05 | | | 240 × 4 |
| 61A | 0.30 | 0.40 | 0.16 | 0.01 | — | 0.01 | 0.03 | 0.02 | No | 500 | Hot, |
| 61B | | | | | | | 0.05 | 0.05 | | | 240 × 4 |
| 62A | 0.45 | 0.50 | 0.17 | 0.02 | — | 0.02 | 0.03 | 0.02 | Yes | 500 | Hot, |
| 62B | | | | | | | 0.05 | 0.05 | | | 320 × 2 |
| 63A | 0.45 | 0.50 | 0.17 | 0.02 | — | 0.02 | 0.03 | 0.02 | Yes | 500 | Cold, |
| 63B | | | | | | | 0.05 | 0.05 | | | 320 × 2 |

TABLE 4-continued

| Alloy No. | Cold rolling reduction ratio % | Final annealing ° C. × hr | Tensile Strength N/mm$^2$ | Thermal conductivity W/mK | Electric conductivity (IACS) % | Work-Ability |
|---|---|---|---|---|---|---|
| Example | | | | | | |
| 60A | 20 | None | 177 | 219 | 58.3 | ○ |
| 60B | | | 178 | 213 | 56.8 | |
| 61A | 85 | None | 182 | 218 | 58.1 | ○ |
| 61B | | | 181 | 212 | 56.3 | |
| 62A | 85 | None | 157 | 221 | 58.8 | ○ |
| 62B | | | 157 | 215 | 57.0 | |
| 63A | 70 | None | 151 | 220 | 59.0 | ○ |
| 63B | | | 151 | 217 | 57.5 | |

*Timing of Heat Treatment: "Hot" denotes "After hot-rolling"; "Cold" denotes "During the cold-rolling.

TABLE 5

| Alloy | Composition (mass %) balance: A1 | | | | | | Homo-gen-izing Process- | Pre-heating | Heat treatment* | Cold rolling reduction | Final annealing | Tensile Strength | Thermal conduct-ivity | Electric conduct-ivity | Work- |
|---|---|---|---|---|---|---|---|---|---|---|---|---|---|---|---|
| No. | Si | Mg | Fe | Cu | Ti | B | ing | ° C. | ° C. × hr | ratio % | ° C. × hr | N/mm$^2$ | W/mK | (IACS) % | Ability |
| Comparative Example | | | | | | | | | | | | | | | |
| 1 | 0.05 | 0.00 | 0.15 | 0.00 | 0.01 | — | Commercially available rolled plate A1070P-H24 | | | | | 100 | 233 | 62.1 | ○ |
| 2 | 0.09 | 0.00 | 0.25 | 0.10 | 0.02 | — | Commercially available rolled plate A1050P-H24 | | | | | 110 | 230 | 61.3 | ○ |
| 3 | 0.12 | 0.01 | 0.58 | 0.12 | 0.02 | — | Commercially available rolled plate A1100P-H24 | | | | | 130 | 220 | 58.4 | ○ |
| 4 | 0.08 | 2.55 | 0.19 | 0.01 | 0.02 | — | Commercially available rolled plate A5052P-H34 | | | | | 260 | 137 | 34.9 | ○ |
| 5 | 0.43 | 0.65 | 0.20 | 0.03 | 0.02 | — | Commercially available extruded member A6063S-T6 | | | | | 240 | 201 | 53.1 | X |
| 6 | 0.12 | 0.27 | 0.24 | 0.01 | 0.02 | — | No | 500 | Hot, 240 × 4 | 85 | None | 170 | 200 | 52.8 | Δ |
| 7 | 0.45 | 1.20 | 0.20 | 0.02 | 0.02 | — | No | 500 | Hot, 240 × 4 | 85 | None | 285 | 155 | 40.0 | X |
| 8 | 0.90 | 0.45 | 0.18 | 0.02 | 0.02 | — | No | 500 | Hot, 240 × 4 | 85 | None | 145 | 160 | 41.5 | X |
| 9 | 0.45 | 0.50 | 0.17 | 0.02 | 0.02 | — | No | 500 | Hot, 420 × 4 | 85 | None | 125 | 218 | 57.9 | X |
| 10 | 0.45 | 0.50 | 0.17 | 0.02 | 0.02 | — | No | 500 | Cold, 240 × 4 | 15 | None | 120 | 200 | 53.6 | ○ |

The underlined denotes "out of the range" defined by the invention
*Timing of Heat Treatment: "Hot" denotes "After hot-rolling"; "Cold" denotes "During the cold rolling.

From the results shown in Tables 1 to 5, it is confirmed that an aluminum alloy plate having high thermal conductivity and electric conductivity equal to a pure aluminum and high strength equal to JIS 5052 aluminum alloy and JIS 6063 aluminum alloy can be obtained by conducting the heat-treating under the conditions defined by the present invention. Furthermore, the workability was also good.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

INDUSTRIAL APPLICABILITY

According to the manufacturing method of the present invention, an Al—Mg—Si series alloy plate excellent in thermal conductivity, electrical conductivity, strength and workability can be manufactured by simple steps in which heat treating is performed after a completion of a hot-rolling but before a completion of a cold-rolling. Accordingly, in manufacturing various members requiring these characteristics, performance of these members can be improved by simple steps. Furthermore, the Al—Mg—Si series alloy material of the present invention is excellent in thermal conductivity, electrical conductivity, strength and workability, and can be widely used as various materials requiring these characteristics.

The invention claimed is:

1. A method for manufacturing an Al—Mg—Si series alloy plate, the method comprising:

hot-rolling and subsequently cold-rolling an Al—Mg—Si series alloy ingot, wherein said Al—Mg—Si series alloy ingot consists of Si:0.2 to 0.8 mass %, Mg:0.3 to 1 mass %, Fe:0.5 mass % or less, Cu: 0.5 mass % or less, at least one of elements selected from the group consisting of Ti:0.1 mass % or less and B:0.1 mass % or less and the balance being Al and inevitable impurities, and wherein heat-treating for holding a rolled ingot at 200 to 300° C. for 1 hour or more is performed after a completion of said hot-rolling but before a completion of said cold-rolling and no solution treating is performed after said completion of said cold-rolling.

2. The method for manufacturing an Al—Mg—Si series alloy plate as recited in claim 1, wherein Mn and Cr contained as impurities in said ingot are controlled such that a content of Mn is 0.1 mass % or less and a content of Cr is 0.1 mass % or less.

3. The method for manufacturing an Al—Mg—Si series alloy plate as recited in claim 1 or 2, wherein said heat-treating is performed after said completion of said hot-rolling but before said cold-rolling.

4. The method for manufacturing said Al—Mg—Si series alloy plate as recited in claim 1 or 2, wherein said heat-treating is performed during said cold-rolling.

5. The method for manufacturing said Al—Mg—Si series alloy plate as recited in claim 1, wherein said heat-treating is performed at 220 to 280° C. for 1 to 10 hours.

6. The method for manufacturing said Al—Mg—Si series alloy plate as recited in claim 1, further comprising homogenization processing of said alloy ingot performed at 500° C. or above.

7. The method for manufacturing said Al—Mg—Si series alloy plate as recited in claim 1, wherein said cold-rolling after said heat-treating is performed at a reduction ratio of 20% or more.

8. The method for manufacturing said Al—Mg—Si series alloy plate as recited in claim 7, wherein said reduction ratio is 30% or more.

9. The method for manufacturing said Al—Mg—Si series alloy plate as recited in claim 1, further comprising final annealing performed at 200° C. or below after said completion of said cold-rolling.

10. The method for manufacturing said Al—Mg—Si series alloy plate as recited in claim 9, wherein said final annealing is performed at 110 to 150° C.

11. The method for manufacturing said Al—Mg—Si series alloy plate as recited in claim 1, further comprising preheating said alloy ingot to 450 to 580° C. before performing said hot-rolling.

12. The method for manufacturing said Al—Mg—Si series alloy plate as recited in claim 1, wherein said hot-rolling includes a plurality of passes, and wherein a material temperature before one of said passes is set to be 450 to 350° C. and a cooling rate after said one of said passes is set to be 50° C./minute or more.

13. The method for manufacturing said Al—Mg—Si series alloy plate as recited in claim 1, wherein a Si content of said alloy ingot is 0.32 to 0.6 mass %.

14. The method for manufacturing said Al—Mg—Si series alloy plate as recited in claim 1, wherein a Mg content of said alloy ingot is 0.35 to 0.55 mass %.

15. The method for manufacturing said Al—Mg—Si series alloy plate as recited in claim 1, wherein a Fe content of said alloy ingot is 0.1 to 0.25 mass %.

16. The method for manufacturing said Al—Mg—Si series alloy plate as recited in claim 1, wherein a Cu content of said alloy ingot is 0.1 mass % or less.

17. The method for manufacturing said Al—Mg—Si series alloy plate as recited in claim 1, wherein a Ti content of said alloy ingot is 0.005 to 0.05 mass %.

18. The method for manufacturing said Al—Mg—Si series alloy plate as recited in claim 1, wherein a B content of said alloy ingot is 0.06 mass % or less.

19. The method for manufacturing said Al—Mg—Si series alloy plate as recited in claim 2, wherein a Mn content of said alloy ingot is controlled to be 0.05 mass % or less.

20. The method for manufacturing said Al—Mg—Si series alloy plate as recited in claim 2, wherein a Cr content of said alloy ingot is controlled to be 0.05 mass % or less.

21. The method for manufacturing said Al—Mg—Si series alloy plate as recited in claim 2, wherein said heat-treating is performed at 220 to 280° C. for 1 to 10 hours.

22. The method for manufacturing said Al—Mg—Si series alloy plate as recited in claim 2, further comprising homogenization processing of said alloy ingot performed at 500° C. or above.

23. The method for manufacturing said Al—Mg—Si series alloy plate as recited in claim 2, wherein said cold-rolling after said heat-treating is performed at a reduction ratio of 20% or more.

24. The method for manufacturing said Al—Mg—Si series alloy plate as recited in claim 23, wherein said reduction ratio is 30% or more.

25. The method for manufacturing said Al—Mg—Si series alloy plate as recited in claim 2, further comprising final annealing performed at 200° C. or below after said completion of said cold-rolling.

26. The method for manufacturing said Al—Mg—Si series alloy plate as recited in claim 25, wherein said final annealing is performed at 110 to 150° C.

27. The method for manufacturing said Al—Mg—Si series alloy plate as recited in claim 2, further comprising preheating said alloy ingot to 450 to 580° C. before performing said hot-rolling.

28. The method for manufacturing said Al—Mg—Si series alloy plate as recited in claim 2, wherein said hot-rolling includes a plurality of passes, and wherein a material temperature before one of said passes is set to be 450 to 350° C. and a cooling rate after said one of said passes is set to be 50° C./minute or more.

29. The method for manufacturing said Al—Mg—Si series alloy plate as recited in claim 2, wherein a Si content of said alloy ingot is 0.32 to 0.6 mass %.

30. The method for manufacturing said Al—Mg—Si series alloy plate as recited in claim 2, wherein a Mg content of said alloy ingot is 0.35 to 0.55 mass %.

31. The method for manufacturing said Al—Mg—Si series alloy plate as recited in claim 2, wherein a Fe content of said alloy ingot is 0.1 to 0.25 mass %.

32. The method for manufacturing said Al—Mg—Si series alloy plate as recited in claim 2, wherein a Cu content of said alloy ingot is 0.1 mass % or less.

33. The method for manufacturing said Al—Mg—Si series alloy plate as recited in claim 2, wherein a Ti content of said alloy ingot is 0.005 to 0.05 mass %.

34. The method for manufacturing said Al—Mg—Si series alloy plate as recited in claim 2, wherein a B content of said alloy ingot is 0.06 mass % or less.

35. A method for manufacturing an Al—Mg—Si series alloy plate, the method comprising:

hot-rolling and subsequently cold-rolling an Al—Mg—Si series alloy ingot, wherein said Al—Mg—Si series alloy ingot consists of Si:0.2 to 0.8 mass %, Mg:0.3 to 1 mass %, Fe:0.5 mass % or less, Cu: 0.5 mass % or less, at least one of elements selected from the group consisting of Ti:0.1 mass % or less and B:0.1 mass % or less and the balance being Al and inevitable impurities, and wherein heat-treating for holding a rolled ingot at 220 to 280° C. for 1 hour or more is performed after a completion of said hot-rolling but before a completion of said cold-rolling and no solution treating is performed after said completion of said cold rolling.

36. The method for manufacturing an Al—Mg—Si series alloy plate as recited in claim 35, wherein Mn and Cr contained as impurities in said ingot are controlled such that a content of Mn is 0.1 mass % or less and a content of Cr is 0.1 mass % or less.

* * * * *